US009379480B2

(12) United States Patent
Sato et al.

(10) Patent No.: US 9,379,480 B2
(45) Date of Patent: Jun. 28, 2016

(54) CONNECTOR AND INJECTION METHOD FOR FILLER MATERIAL

(71) Applicant: YAZAKI CORPORATION, Tokyo (JP)

(72) Inventors: Akira Sato, Makinohara (JP); Kazuhide Takahashi, Makinohara (JP); Etsuro Suzuki, Makinohara (JP); Kenji Takahashi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/548,698

(22) Filed: Nov. 20, 2014

(65) Prior Publication Data

US 2015/0140848 A1 May 21, 2015

Related U.S. Application Data

(63) Continuation of application No. PCT/JP2013/066219, filed on Jun. 12, 2013.

(30) Foreign Application Priority Data

Jun. 21, 2012 (JP) ..... 2012-140196

(51) Int. Cl.

| | |
|---|---|
| ***H01R 13/52*** | (2006.01) |
| ***H01R 43/00*** | (2006.01) |
| ***H01R 43/24*** | (2006.01) |
| *H01R 13/502* | (2006.01) |

(52) U.S. Cl.

CPC ..... *H01R 13/5216* (2013.01); *H01R 13/5202* (2013.01); *H01R 13/5205* (2013.01); *H01R 43/005* (2013.01); *H01R 43/24* (2013.01); *H01R 13/502* (2013.01); *H01R 2201/26* (2013.01)

(58) Field of Classification Search

CPC ..... H01R 13/5219; H01R 13/5202; H01R 13/5205; H01R 13/5221; H01R 13/5216

USPC ..... 439/271, 587, 936

See application file for complete search history.

(56) References Cited

U.S. PATENT DOCUMENTS 4,083,902 A * 4/1978 Clyde ..... 264/420
5,637,007 A * 6/1997 Suzuki et al. ..... 439/276

(Continued)

FOREIGN PATENT DOCUMENTS

CN 101601173 A 12/2009
CN 101609955 A 12/2009

(Continued)

OTHER PUBLICATIONS

Japanese Office Action issued in Japanese Patent Application No. 2012-140196 on Nov. 17, 2015.

(Continued)

*Primary Examiner* — Hien Vu

(74) *Attorney, Agent, or Firm* — Morgan, Lewis & Bockius LLP

(57) ABSTRACT

A connector includes a connector housing, an inner plate that supports a terminal connected to a one end portion of an electric wire and that is accommodated in an inside of the connector housing, and filler material that fills the inside of the connector housing which has accommodated the inner plate and that is then hardened so as to cover a connection part of the electric wire and the terminal. The filler material adheres to a first portion within an inner surface of the connector housing and to an outer surface of the inner plate. A release layer is provided between a second portion within the inner surface of the connector housing and an outer surface of the filler material opposite to the second portion.

3 Claims, 8 Drawing Sheets

(56) References Cited

U.S. PATENT DOCUMENTS

| | | | | |
|---|---|---|---|---|
| 6,102,739 | A | 8/2000 | Murakami | |
| 6,689,957 | B2 | 2/2004 | Onoda | |
| 8,502,090 | B2 * | 8/2013 | Winship | 174/650 |
| 2002/0125651 | A1 | 9/2002 | Onoda | |
| 2005/0009394 | A1 | 1/2005 | Kameyama et al. | |
| 2010/0075535 | A1 | 3/2010 | Mizutani et al. | |
| 2013/0224979 | A1 * | 8/2013 | Sato et al. | 439/271 |

FOREIGN PATENT DOCUMENTS

| | | | |
|---|---|---|---|
| DE | 10 2008 031 085 | A1 | 1/2010 |
| JP | H10-050372 | A | 2/1998 |
| JP | 2002-270283 | A | 9/2002 |
| JP | 2005-5177 | A | 1/2005 |
| JP | 2012-059652 | A | 3/2012 |
| JP | 2012-059653 | A | 3/2012 |
| JP | 2012-084482 | A | 4/2012 |
| JP | 2012-089340 | A | 5/2012 |

OTHER PUBLICATIONS

International Search Report dated Aug. 20, 2013 for International application No. PCT/JP2013/066219.

Chinese Office Action issued in Chinese Patent Application No. 201380033054.1 on Mar. 3, 2016.

* cited by examiner

CONNECTOR AND INJECTION METHOD FOR FILLER MATERIAL

CROSS REFERENCE TO RELATED APPLICATION

This application is a continuation of PCT application No. PCT/JP2013/066219, which was filed on Jun. 12, 2013 based on Japanese Patent Application (No. 2012-140196) filed on Jun. 21, 2012, the contents of which are incorporated herein by reference. Also, all the references cited herein are incorporated as a whole.

BACKGROUND

1. Technical Field

The present invention relates to a connector and an injection method for filler material.

2. Background Art

In some connectors, a situation that liquid present in the outside of a connector enters the inside of the connector is required to be avoided, that is, a liquid-tight property is required.

In the conventional art, for the purpose of providing a connector having a high liquid-tight property, connectors having various kinds of structures have been proposed (for example, see JP-A-2002-270283 and JP-A-2012-59652).

SUMMARY

For example, the connector disclosed in JP-A-2002-270283 and JP-A-2012-59652 is attached and fixed to an automatic transmission (AT) of an automobile or the like.

Outlines of the structures of the connectors according to the conventional art disclosed in JP-A-2002-270283 and JP-A-2012-59652 are described below. Such a connector includes a connector housing formed in an approximately tubular shape whose both ends are opened. In the connector housing, a portion on one-end side is fit to a connector housing of a counterpart connector and a portion on the other-end side is fit to a housing of an automatic transmission. Further, the connector is arranged and accommodated in the inside of the connector housing, and further includes a terminal holder (an inner plate) for collecting and holding male terminals attached by pressure bonding to individual tip parts of a plurality of electric wires inserted into the other-end side opening of the connector housing. Further, the connector further includes a rubber plug that is press-fit into the other-end side opening of the connector housing in the state of the individual electric wires having been inserted, and that thereby closes the other-end side opening in the state of the individual electric wires being collected and held. In the connector, a space formed between the terminal holder and the rubber plug in the inside of the connector housing is filled with epoxy resin (filler material). Then, the epoxy resin (the filler material) is hardened so that the terminal holder and the individual electric wires are held. By virtue of this, in the connector, a connector fitting chamber formed in the inside of a one-end side opening of the connector housing and faced by the individual terminals is sealed in a liquid-tight manner.

Nevertheless, in such a connector of the conventional art, a possibility is present that as the operating time increases, cracks are generated in the epoxy resin serving as the filler material. Further, when cracks are once generated in the filler material, the cracks may gradually grow in the inside of the filler material as time advances further.

When cracks are generated in the filler material, a possibility arises that, for example, AT oil having crept by a capillary phenomenon the electric wires inserted into the terminal holder and then entered the inside of the connector housing moves through the inside of the cracks so as to exude into the connector fitting chamber so that the liquid-tight property of the connector is lost.

The present invention has been devised in view of the situations described above. An object thereof is to provide a connector and an injection method for filler material in which generation of cracks in filler material filling the inside of a connector housing can be suppressed.

For the purpose of achieving the object described above, the connector according to the present invention is characterized by the following (1) to (3).

(1) There is provided a connector including:

a connector housing having a tubular shape;

an inner plate that supports a terminal connected to a one end portion of an electric wire and that is accommodated in an inside of the connector housing; and filler material that fills the inside of the connector housing which has accommodated the inner plate and that is then hardened so as to cover a connection part of the electric wire and the terminal, wherein the filler material adheres to a first portion within an inner surface of the connector housing and to an outer surface of the inner plate, and wherein between a second portion within the inner surface of the connector housing and an outer surface of the filler material opposite to the second portion, a release layer is provided that is composed of releasing material and is interposed in contact with the second portion and the outer surface of the filler material.

(2) In the connector described in the above-mentioned (1), the release layer is provided between the second portion and the outer surface of the filler material adhering to a portion of the outer surface of the inner plate opposite to the second portion.

(3) In the connector described in the above-mentioned (1) or (2), the release layer is formed such as to face a space for accommodating a counterpart connector housing within the inside of the connector housing.

Further, for the purpose of achieving the object described above, the injection method for filler material according to the present invention is characterized by the following (4).

(4) There is provided an injection method for filler material, including:

an coating step of coating, with release material composed of releasing material, a portion within an inner surface of a connector housing having a tubular shape; and a filling step of filling filler material an inside of the connector housing which has accommodated an inner plate for supporting a terminal connected to a one end portion of an electric wire such that the filler material covers a connection part of the electric wire and the terminal, and then hardening the filler material so that the filler material adheres to another portion within the inner surface of the connector housing and to an outer surface of the inner plate so that the filler material is brought into contact with the release material.

Operation of the connector according to the present invention is described below.

The inventors of the present invention have found a possibility that a cause of generation of cracks in filler material in a connector of the conventional art is attributed to a thermal stress generated in the filler material.

For example, when a connector is attached to an automatic transmission, the ambient temperature of the connector varies depending on the temperature in the inside of the automatic transmission whose temperature rises during engine drive and falls during engine shutdown. Here, in the connector of the conventional art, the filler material filling the connector housing is constrained by the connector housing. Thus, when the ambient temperature of the connector varies, a thermal stress instead of a strain is generated in the filler material. Thus, when variation in the ambient temperature of the connector is repeated, a thermal stress is repeatedly generated in the filler material. As a result, the filler material becomes fatigued and degraded so that a possibility arises that cracks are generated in the filler material.

Further, as another cause of generation of cracks in the filler material in a connector of the conventional art, a possibility is present that cracks are generated also when an external force from a counterpart connector fit to the inside of the connector housing acts on the filler material having become fatigued and degraded by the above-mentioned cause. Further, as yet another cause of generation of cracks in the filler material in a connector of the conventional art, a possibility is present that cracks in the inside of the filler material having become fatigued and degraded by the above-mentioned cause are generated also when the ambient temperature of the connector varies rapidly so that a thermal stress caused by the rapid temperature variation is generated in the filler material (i.e., a thermal shock).

In contrast, in the connector of the configuration of the above-mentioned (1), a second portion within the inner surface of the connector housing and the outer surface of the filler material opposite to the second portion are released from each other by the release layer composed of releasing material being interposed in contact with and between the second portion and the outer surface of the filler material. Thus, in comparison with a case of absence of the release layer, the extent of constraint on the filler material by the connector housing is alleviated. Thus, in comparison with a case of absence of the release layer, a larger amount of free expansion and free contraction is allowed to the filler material when the ambient temperature of the connector varies. This reduces a thermal stress generated in the filler material and hence suppresses fatigue and degradation in the filler material. Further, a thermal shock generated in the filler material is reduced. As a result, generation of cracks in the filler material is suppressed.

Further, in the connector of the configuration of the above-mentioned (2), the portion where the release layer is formed is located near a portion where the terminals, the electric wires, and the inner plate which have thermal expansion coefficients different from that of the filler material are collected. Thus, in this portion, when those portions adhere to each other in a case of absence of the release layer, a thermal stress is easily generated so that cracks are easily generated. In contrast, in the connector of the configuration of the above-mentioned (2), since the portions are released from each other, generation of cracks in the filler material is suppressed.

Further, in the connector of the configuration of the above-mentioned (3), the release layer is formed such as to face a space for accommodating the counterpart connector housing. Thus, the release layer can be provided easily. Further, the extent of constraint on the filler material by the connector housing is alleviated. This reduces a thermal stress generated in the filler material and hence suppresses generation of cracks in the filler material.

According to the injection method for filler material of the configuration of the above-mentioned (4), the filler material is caused to fill the inside of the connector housing such that between a portion within the inner surface of the connector housing and the outer surface of the filler material opposite to the portion, the release layer is formed that is interposed in contact with the portion and the outer surface of the filler material. As a result, a thermal stress generated in the filler material is reduced and hence fatigue and degradation in the filler material are suppressed. This suppresses generation of cracks in the filler material.

According to the connector and the injection method for filler material of the present invention, a connector and an injection method for filler material can be provided in which generation of cracks in filler material filling the inside of a connector housing can be suppressed.

The present invention has briefly been described above. Details of the present invention will be clarified further when Best Mode for Carrying Out the Invention (referred to as an "embodiment", hereinafter) given below is read thoroughly with reference to the accompanying drawings.

DETAILED DESCRIPTION OF THE EXEMPLARY EMBODIMENTS

An embodiment of a connector according to the present invention is described below with reference to FIGS. 1 to 8.

Figure 1:
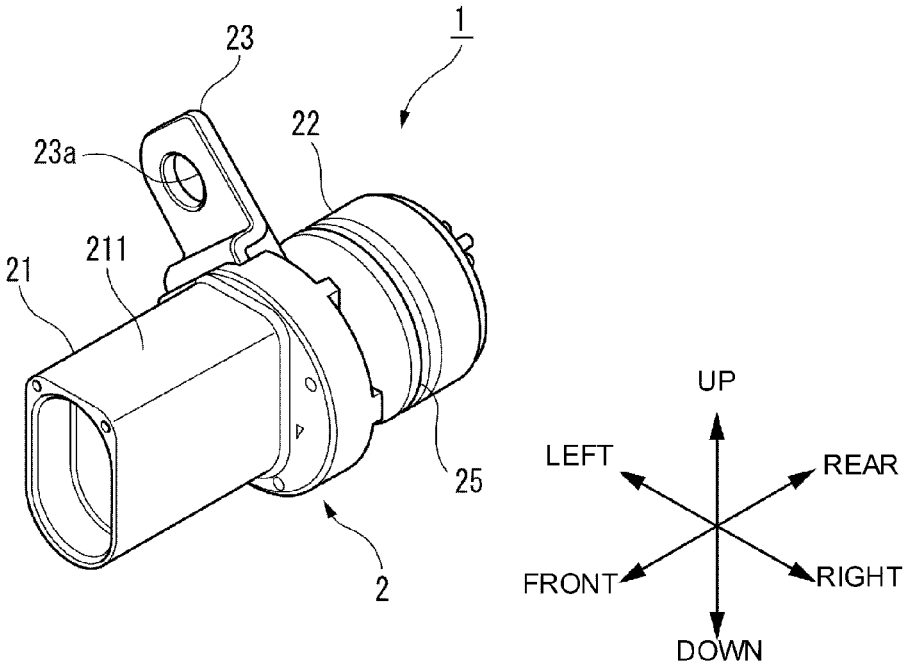
FIG. 1 is a perspective view showing an external appearance of a connector according to an embodiment of the present invention.
Figure 2:
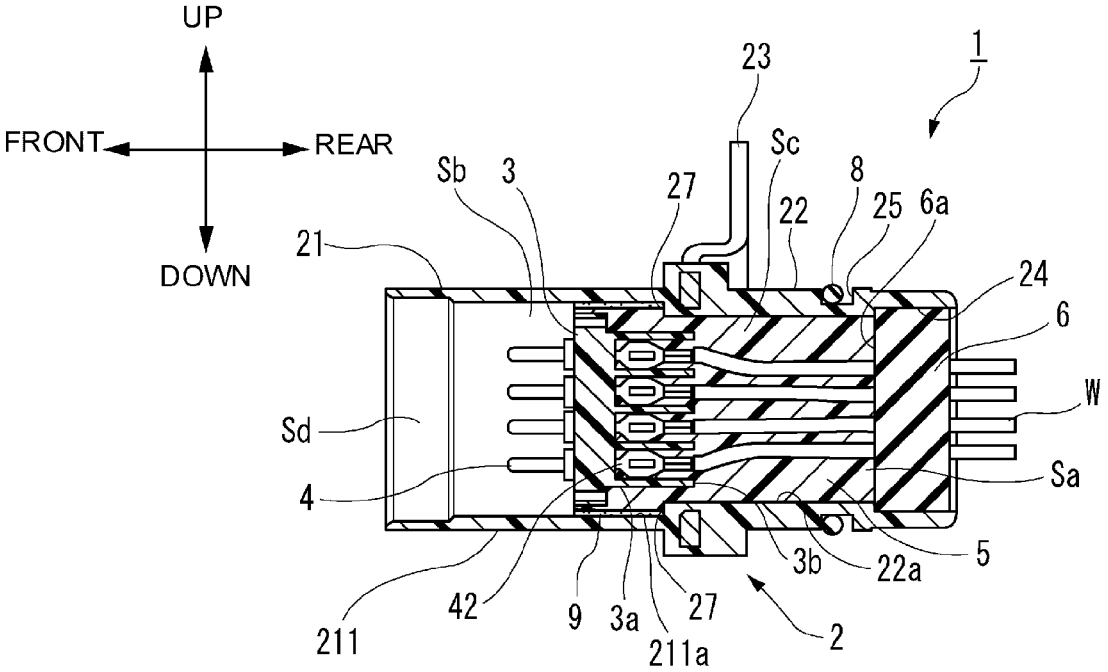
FIG. 2 is a longitudinal sectional view of a connector of FIG. 1.
Figure 3:
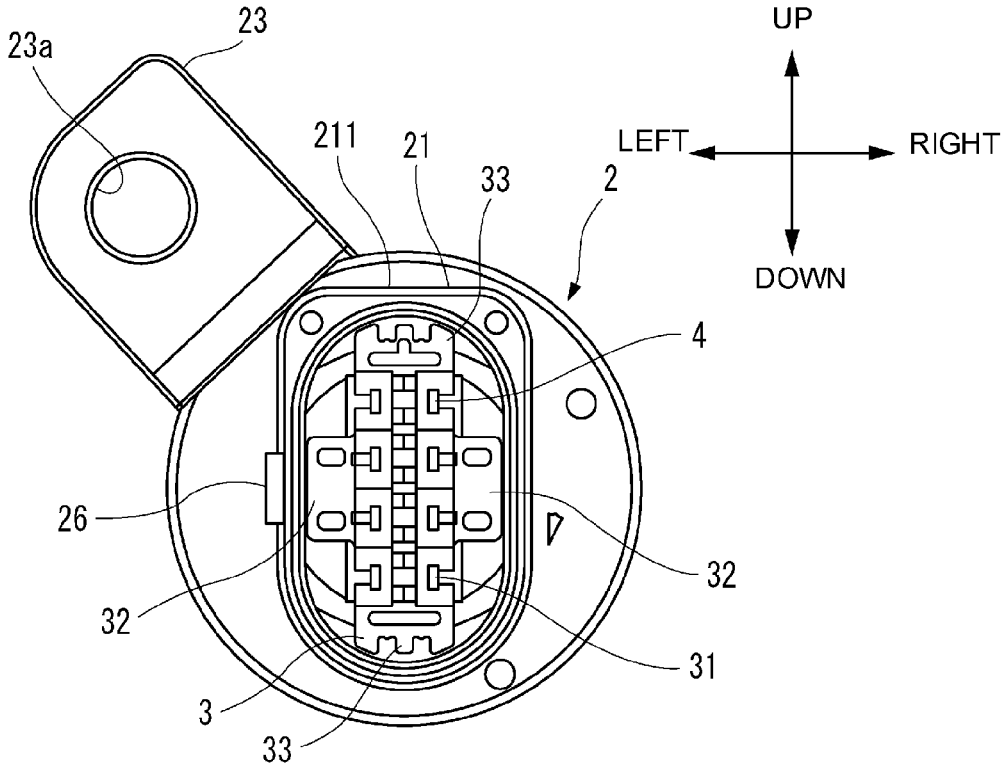
FIG. 3 is a diagram in which a connector of FIG. 1 is viewed from the front side.

FIG. 1 is a perspective view showing an external appearance of a connector 1. FIG. 2 is a longitudinal sectional view of the connector 1 of FIG. 1. FIG. 3 is a diagram in which the connector 1 of FIG. 1 is viewed from the front side. In the following description of the specification, the front side, the rear side, the up side, the down side, the left side, and the right side are defined as indicated by arrows in each figure.

The connector 1 according to the present embodiment is a connector capable of being suitably used not only under a general operating environment in which the ambient temperature varies depending on the atmospheric temperature but also under an environment in which the ambient temperature varies considerably with a short period. For example, the connector 1 is attached to the automatic transmission of an automobile. That is, the connector 1 is capable of being used under an environment in which the ambient temperature varies depending on the temperature in the inside of the automatic transmission whose temperature rises during engine drive and falls during engine shutdown.

As shown in FIGS. 1 and 2, the connector 1 includes a connector housing 2 having an approximately tubular shape fit to a case (not shown; referred to as a mission case, in some cases hereinafter) of the automatic transmission. Further, the connector 1 includes an inner plate 3 accommodated in the inside of a terminal accommodation part 21 provided on a front side of the connector housing 2. The inner plate 3 holds individual male terminals 4 electrically connected respectively to one end portions of a plurality of electric wires W by pressure bonding. Further, the connector 1 further includes filler material 5 that fills a filling space Sa formed mainly on the rear side in the inside of the connector housing 2 and is then hardened so as to hold the one-end portions of the individual electric wires W and the inner plate 3 in the inside of the connector housing 2. Further, the connector 1 further includes a rubber plug 6 inserted into an opening on the rear side of the connector housing 2. The rubber plug 6 is a plug member in which the individual electric wires W are inserted through openings thereof and which closes the rear side opening of the connector housing 2. Further, the connector 1 further includes an O-ring 8 fit onto a rear side outer peripheral surface of the connector housing 2. The O-ring 8 is an annular sealing member for establishing sealing between the connector housing 2 and the mission case in a liquid-tight manner. Then, the terminal accommodation part 21 fit to a counterpart connector (not shown) so that a front end portion (not shown) of a connector housing of the counterpart connector is accommodated in the inside of the terminal accommodation part 21. At that time, the individual terminals 4 are inserted into female terminals (not shown) accommodated in the inside of the counterpart connector so that they are electrically connected to each other so that the electric wires W and the counterpart electric wires go into electric conduction to each other.

The connector housing 2 is formed in a tubular shape as the entirety by using predetermined resin material. The connector housing 2 includes a terminal accommodation part 21 provided on a front side of the connector housing 2. The inside of the terminal accommodation part 21 accommodates the inner plate 3 and the individual terminals 4. Further, the connector housing 2 further includes an electric wire accommodation part 22 provided on a rear side of the connector housing 2 such as to be located adjacent to the terminal accommodation part 21. The inside of the electric wire accommodation part 22 accommodates a part on one-end side of the individual electric wires W. Further, the connector housing 2 further includes a bracket part 23 protruding from the outer peripheral surface of the electric wire accommodation part 22. The bracket part 23 is used for fixing the connector housing 2 to the mission case. Then, the electric wire accommodation part 22 is fit to the inside of a connector accommodation part (not shown) formed in a hollow manner in the mission case. By virtue of the connector housing 2 is fixed to the mission case through the bracket part 23 with a bolt (not shown). As a result, in a state that the terminal accommodation part 21 faced by the individual terminals 4 is opened toward the mission case outside, the electric wire accommodation part 22 of the connector housing 2 is accommodated in the inside of the connector accommodation part of the mission case.

The terminal accommodation part 21 is formed in the shape of a rectangular tube having an approximately rectangular shape. Then, the inside thereof is provided with a terminal accommodation space Sb in which an opening having an elliptic shape whose major axis is in the up and down directions and whose minor axis is in the right and left directions is formed in a hollow manner in the frontward and rearward directions. In the inner surfaces in the right and left directions within the inner surface of the peripheral wall 211 of the terminal accommodation part 21, locking pawls (not shown) to which lock arms 32 and 32 (see FIG. 3 or the like) formed in the inner plate 3 are locked respectively so that the inner plate 3 is fixed to the connector housing 2 are formed and protrude opposite to each other. Here, these locking pawls (not shown) are each provided with a guide surface (not shown) formed such that the height thereof gradually decreases toward the front side of the terminal accommodation part 21. By virtue of this, since the lock arms 32 and 32 are guided by the guide surfaces, the inner plate 3 inserted from the front side of the terminal accommodation part 21 is smoothly locked by the locking pawls (not shown). Thus, the inner plate 3 is easily fixed to the connector housing 2.

Figure 6:
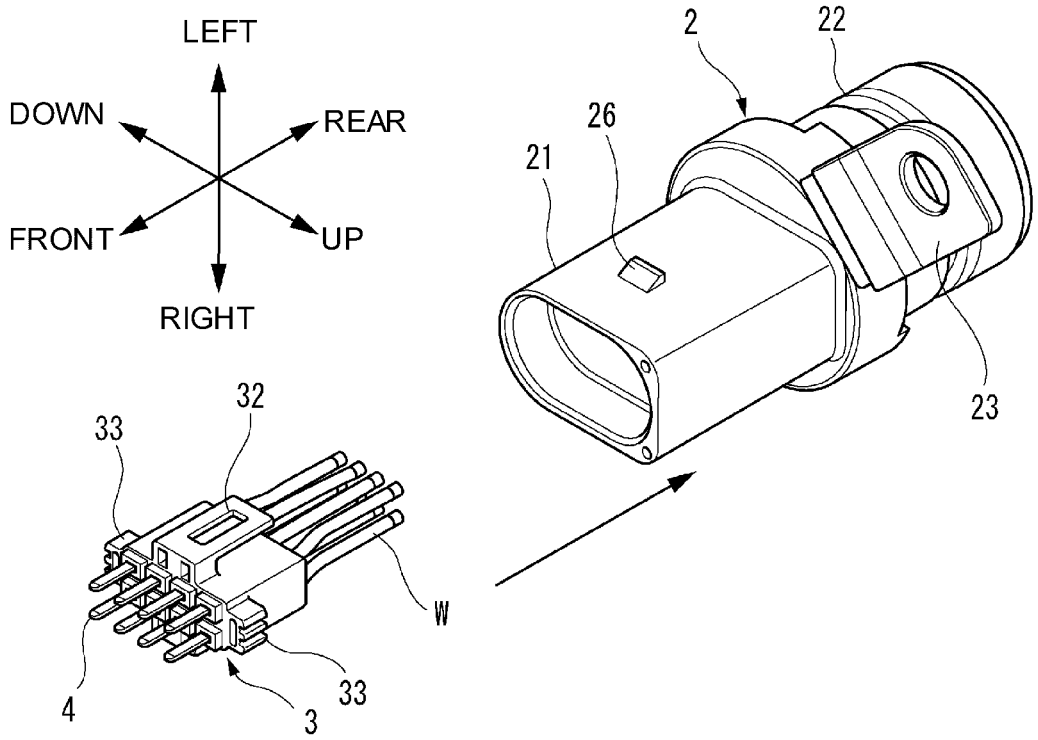
FIG. 6 is a perspective view showing an inner plate insertion step of inserting an inner plate obtained at a terminal insertion step, into a connector housing obtained at a coating step.

Further, as shown in FIG. 6, from the left side outer surface within the outer surface of the peripheral wall 211, a locking projection 26 protrudes for being locked by a locking pawl (not shown) of the counterpart connector. When the locking pawl (not shown) of the counterpart connector locks the locking projection 26, the connector 1 and the counterpart connector are fixed to each other.

The electric wire accommodation part 22 is formed in the shape of an approximately circular tube and provided continuously to the rear end of the terminal accommodation part 21. In the inside of the electric wire accommodation part 22, an electric wire accommodation space Sc is formed that is in fluid communication with the terminal accommodation space Sb. Then, in the rear end portion of the electric wire accommodation part 22, a plug member accommodation part 24 is formed for accommodating the rubber plug 6 having the shape of a circular pillar. The plug member accommodation part 24 is formed and opened to the outside with a predetermined inner diameter. The inner diameter of the plug member accommodation part 24 is provided in an expanding diameter form relative to the inner diameter of the electric wire accommodation part 22 for forming the electric wire accommodation space Sc. Here, the inner diameter of the plug member accommodation part 24 is set to be slightly smaller than the outer diameter of the rubber plug 6. Then, the rubber plug 6 is press-fit into the plug member accommodation part 24. Further, the depth of the plug member accommodation part 24 is set to be slightly larger than the thickness of the rubber plug 6. Thus, in the accommodation state of the rubber plug 6, the rubber plug 6 does not protrude from the rear end of the electric wire accommodation part 22.

As shown in FIG. 2, in the terminal accommodation part 21 and the electric wire accommodation part 22, the center line bisecting the terminal accommodation space Sb up and down and the center line bisecting the electric wire accommodation space Sc into up and down approximately agree with each other. Further, the inner shape of the terminal accommodation part 21 is set to be larger than the inner shape of the electric wire accommodation part 22. Thus, in the part portion where the terminal accommodation part 21 and the electric wire accommodation part 22 are linked to each other in the inner surface of the connector housing 2, a step 27 serving as a protruding part is formed in an amount equal to the inner shape difference. The function of the step 27 is described later.

Further, in the outer peripheral surface of the electric wire accommodation part 22, at an approximately middle position in the frontward and rearward directions, an annular sealing member accommodation groove 25 onto which the O-ring 8 is fit is formed over the circumferential direction of the electric wire accommodation part 22. The O-ring 8 is fit to the sealing member accommodation groove 25 so as to be attached to the sealing member accommodation groove 25.

Here, the depth of the sealing member accommodation groove 25 is set to be smaller than the wire diameter of the O-ring 8. Thus, the outer periphery of the O-ring 8 protrudes from the opening edge of the sealing member accommodation groove 25 to the outside in the radial direction. Then, the peripheral part of this protruding O-ring 8 goes into elastic contact with the inner peripheral surface (not shown) of the connector accommodation part of the mission case so that liquid-tight sealing is established between the connector accommodation part and the connector housing 2 (i.e., the electric wire accommodation part 22).

As shown in FIG. 6, in the bracket part 23, a bolt insertion hole 23*a* is formed such as to penetrate in the thickness direction (i.e., in the frontward and rearward directions in FIG. 2). By virtue of a bolt (not shown) inserted into the bolt insertion hole 23*a*, the connector housing 2 is fixed to the mission case.

Figure 5:
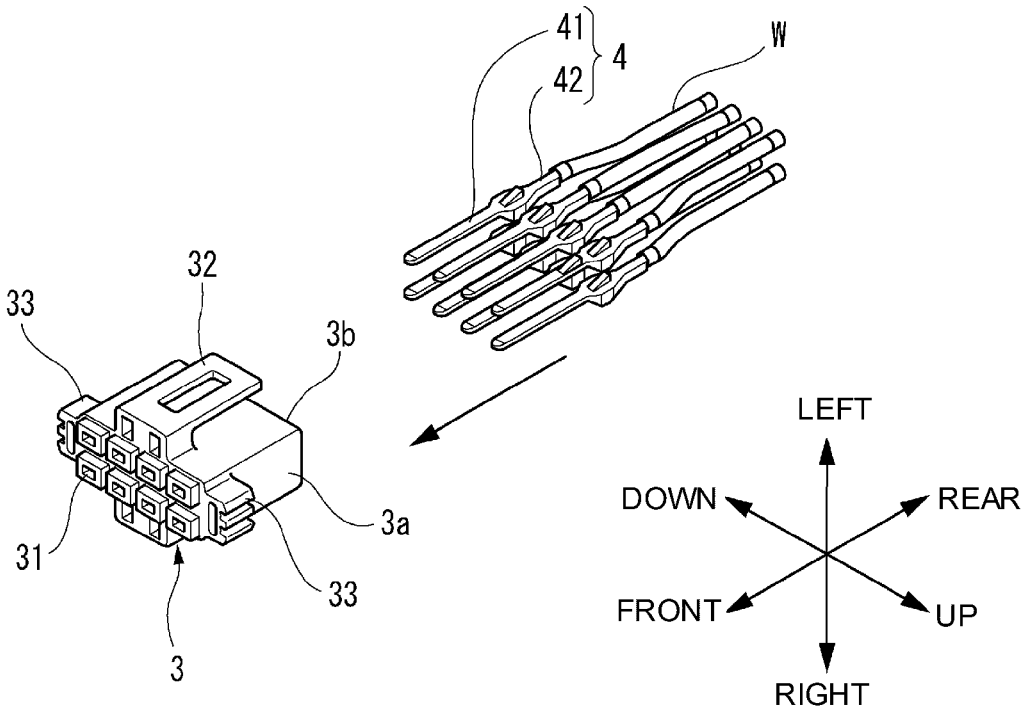
FIG. 5 is a perspective view showing a terminal insertion step of inserting, into an inner plate, terminals to which electric wires are connected by pressure bonding.

As shown in FIGS. 3 and 5, in the inner plate 3, the entirety is formed from predetermined resin material in the shape of an approximately rectangular block. Further, the inside is constructed in a so-called grid shape. Thus, in the inside of the inner plate 3, a plurality of window parts 31 penetrating along the insertion direction of the terminals 4 (in the frontward and rearward directions in FIG. 2) are formed in four pieces in the up and down directions by two rows in the right and left directions. The terminals 4 are respectively inserted into and held by the window parts 31. Each terminal 4 is constructed from: a tip part 41 (an end portion located on the front side in FIG. 2) fabricated from an electrically conductive metal and electrically connected to the female terminal of the counterpart connector, and a connection part 42 located on the pedestal-end side (an end portion located on the rear side in FIG. 2), formed in a wider width than the tip part 41, and attached to one-end portion of the electric wire W by pressure bonding so as to be electrically connected to the electric wire W. Then, the terminal 4 is inserted into the window part 31 from the rear side of the inner plate 3, a portion of the connection part 42 is held in a state of press fit into each window part 31. Then, a portion of the tip part 41 projects from the front side of the window part 31 of the inner plate 3 so as to face the inside of the terminal accommodation part 21.

Further, in the side surfaces in the right and left directions within the side surface 3*a* of the inner plate 3, a pair of lock arms 32 and 32 locked by the individual locking pawls of the connector housing 2 extend respectively along the frontward and rearward directions in FIG. 2 such as to extend to the rear side of the inner plate 3. Further, in the side surfaces in the up and down directions within the side surface 3*a* of the inner plate 3, locking parts 33 and 33 protrude respectively.

For example, the filler material 5 is fabricated from resin material such as epoxy resin having thermoplasticity. As shown in FIG. 2, by a method described later, the filler material 5 is caused to fill by potting the filling space Sa formed between the inner surface of the connector housing 2 and the inner plate 3 and the rubber plug 6 in the inside of the connector housing 2 and is then hardened so as to cover the connection part 42 serving as a connection part for the electric wires W and the terminals 4. The filling space Sa is formed by a portion of the inner surface of the terminal accommodation part 21, the inner surface 22*a* of the electric wire accommodation part 22, the side surfaces 3*a* and 3*b* of the inner plate 3, and the side surface 6*a* of the rubber plug 6 on the front-end side in FIG. 2. The filler material 5 adheres to the inner surface 22*a* of the electric wire accommodation part 22 (a first portion within the inner surface of the connector housing 2), the side surfaces 3*a* and 3*b* of the inner plate 3, and the side surface 6*a* of the rubber plug 6 on the front-end side and thereby holds the inner plate 3 and the individual electric wires W in the connector housing 2. That is, the inner plate 3 and the electric wires W are held by the connector housing 2 with the filler material 5 in between. Further, since the filler material 5 fills the space, the connection site of the connection part 42 for the electric wires W and the terminals 4 is maintained in a liquid-tight state.

As shown in FIG. 2, between the inner surface of the connector housing 2, the side surface of the inner plate 3 and the outer surface of the filler material 5, a release layer 9 composed of releasing material and is interposed in contact with and between the inner surface of the connector housing 2, the side surface of the inner plate 3 and the outer surface of the filler material 5 is formed over the entire circumference. For example, mold-release agent may be employed as the releasing material. More specifically, the release layer 9 is formed between the inner surface 211*a* on the rear-end side of the peripheral wall 211 of the terminal accommodation part 21 (a second portion within the inner surface of the connector housing 2) and the outer surface of the filler material 5 opposite to the inner surface 211*a*. Further, yet more specifically, the release layer 9 is provided between the inner surface 211*a* (a second portion within the inner surface of the connector housing 2) and the outer surface of the filler material 5 adhering to the side surface 3*a* of the inner plate 3 opposite to the inner surface 211*a*. Since the inner surface 211*a* opposite to the filler material 5 within the inner surface of the peripheral wall 211 of the terminal accommodation part 21 is provided with the release layer 9, the filler material 5 is not fixed to the terminal accommodation part 21. That is, the filler material 5 is released from the terminal accommodation part 21. Further, alternatively, when the release layer 9 is regarded as a portion of the inner surface of the connector housing 2, an interpretation is allowed that the filler material 5 and the inner surface 211*a* of the terminal accommodation part 21 are in contact with each other and that the friction coefficient between the filler material 5 and the inner surface 211*a* is considerably small and the friction coefficient is smaller than the friction coefficient between the filler material 5 and the inner surface 22*a* of the electric wire accommodation part 22. Further, the release layer 9 is formed such as to face a counterpart connector accommodation space Sd serving as a space for accommodating a counterpart connector housing (not shown) within the terminal accommodation part 21. In other words, the release layer 9 is formed in a manner that a part thereof faces the counterpart connector accommodation space Sd.

Figure 7:
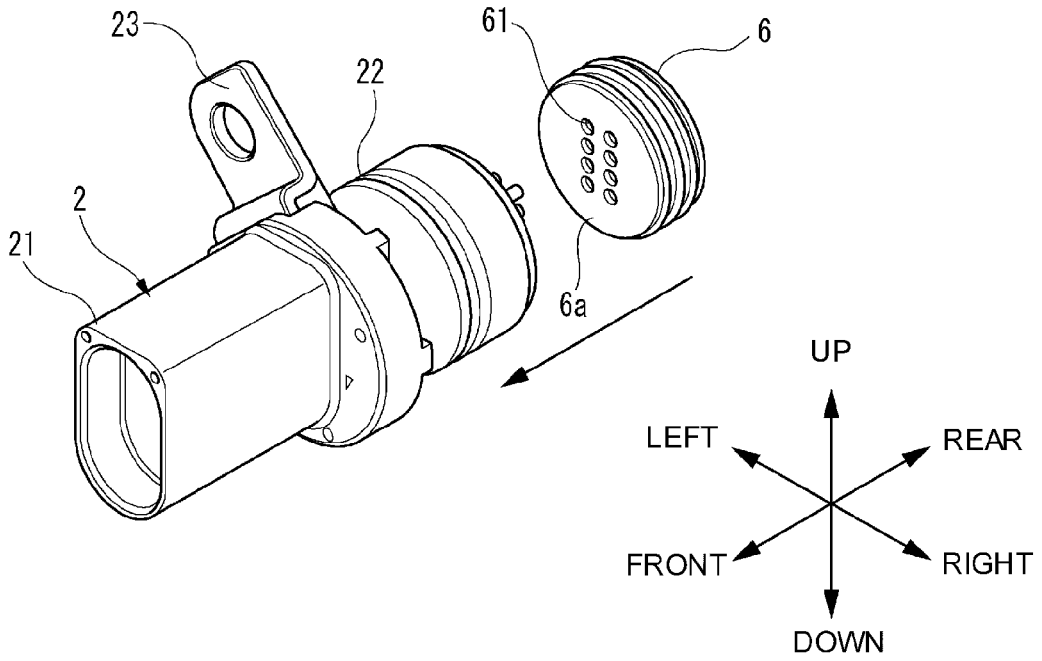
FIG. 7 is a perspective view showing a plug member insertion step of inserting a rubber plug into a connector housing obtained at an inner plate insertion step.

As shown in FIG. 7, the rubber plug 6 serving as a plug member is formed in the shape of an approximately circular pillar and press-fit into the inside of the plug member accommodation part 24 so as to close the rear-end side opening of the connector housing 2 in a state that the outer periphery part is in elastic contact with the inner peripheral wall of the plug member accommodation part 24. Thus, at a filling step described later, a construction is realized that the filler material 5 in a liquid state before hardening that fills the filling space Sa does not leak through the rear-end side opening of the connector housing 2. Further, by virtue of this, the rear-end side opening of the connector housing 2 is sealed in a liquid-tight manner. Then, in the rubber plug 6, a plurality of electric wire insertion holes 61 which are formed in four pieces in the up and down directions by two rows in the right and left directions in correspondence to the individual window parts 31 of the inner plate 3 and through which the electric wires W are inserted (penetrate) are formed along the thickness direction of the rubber plug 6 in a penetrated manner. By virtue of this, the other-end sides of the electric wires W can be pulled out through the electric wire insertion holes 61 to the rearward direction relative to the plug member accommodation part 24. Here, in each electric wire insertion hole 61, the inner diameter of a portion in the frontward and rearward directions is set to be slightly smaller than the wire diameter of the electric wire W. The rubber plug 6 is in elastic contact with the individual outer peripheral surfaces of the electric wires W inserted in the inside of the electric wire insertion holes 61 so that liquid-tight sealing is established between itself and the electric wires W. This also realizes a construction that the filler material 5 in a liquid state that fills the filling space Sa does not leak through the rear-end side opening of the connector housing 2. Further, the rear-end side opening of the connector housing 2 is sealed in a liquid-tight manner.

Figure 8:
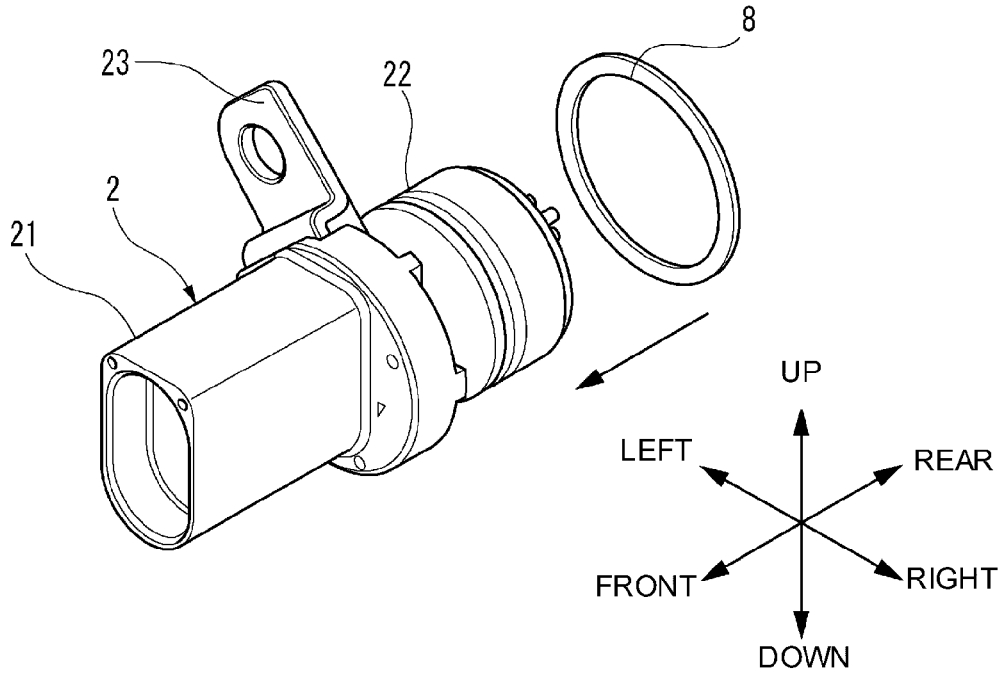
FIG. 8 is a perspective view showing a sealing member attachment step of attaching an O-ring to a connector housing.

As shown in FIGS. 2 and 8, the O-ring 8 serving as a sealing member is a well-known O-ring and is fit onto the sealing member accommodation groove 25 so as to be fixed to the connector housing 2. Then, the outer periphery part the O-ring 8 goes in elastic contact with the inner peripheral surface of the connector accommodation part of the mission case so that liquid-tight sealing is established between the mission case and the connector housing 2.

Figure 4:
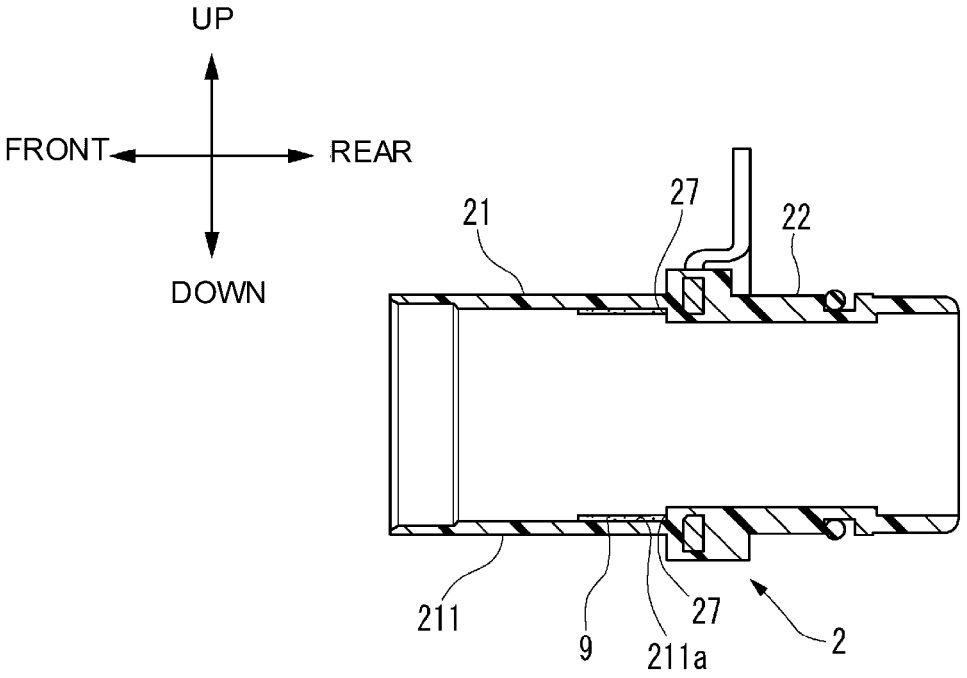
FIG. 4 is a longitudinal sectional view of a connector obtained at a coating step.

A fabrication method for the connector 1 according to the present embodiment including an injection method for filler material of the present invention is described below with reference to FIGS. 4 to 8. FIG. 4 is a longitudinal sectional view of the connector 1 obtained at a coating step. FIG. 5 is a perspective view showing a terminal insertion step of inserting, into the inner plate 3, the terminals 4 to which electric wires W are connected by pressure bonding. FIG. 6 is a perspective view showing an inner plate insertion step of inserting the inner plate 3 obtained at the terminal insertion step, into the connector housing 2 obtained at the coating step. FIG. 7 is a perspective view showing a plug member insertion step of inserting the rubber plug 6 into the connector housing 2 obtained at the inner plate insertion step. FIG. 8 is a perspective view showing a sealing member attachment step of attaching the O-ring 8 to the connector housing 2.

The following description of the fabrication method for the connector 1 is given for a mode that a worker performs the work concerning the fabrication. However, the mode of implementation of the present invention is not limited to this. For example, a mode may be employed that a part or the entirety of the work concerning the fabrication is performed by a fabrication apparatus.

In the fabrication method for the connector 1 according to the present embodiment, first, the worker performs a coating step of coating the inner surface of the connector housing 2 with release material composed of releasing material. Then, the worker performs a terminal insertion step of inserting into the inner plate 3 the terminals 4 connected to the electric wires W by pressure bonding. Then, the worker performs an inner plate insertion step of inserting the inner plate 3 obtained at the terminal insertion step, into the connector housing 2 obtained at the coating step. Then, the worker performs a plug member insertion step of inserting the rubber plug 6 into the connector housing 2 obtained at the inner plate insertion step. Then, the worker performs a filling step of causing the filler material 5 to fill the inside of the connector housing 2 obtained at the plug member insertion step and of then hardening the filler material 5. Then, the worker performs a sealing member attachment step of attaching the O-ring 8 to the connector housing 2 obtained at the filling step. The above-mentioned steps are described below one by one.

At the coating step, as shown in FIG. 4, the worker coats the inner surface of the connector housing 2 with release material composed of releasing material. More specifically, the worker applies the release material over the entire circumference of the inner surface 211*a* of the peripheral wall 211 of the terminal accommodation part 21. As a result, the release layer 9 is formed on the surface of the inner surface 211*a* of the connector housing 2. At that time, as shown in FIG. 4, the worker applies the release material on the inner surface 211*a* of the peripheral wall 211 in a manner that the step 27 is located at one edge of the release layer 9. By virtue of this, the worker can easily identify the application region for the release material at the time of application of the release material onto the inner surface of the connector housing 2.

At the terminal insertion step, the worker performs pressure bonding of the connection part 42 of the terminals 4 to one-end portions of the electric wires W so as to achieve connection by pressure bonding between the electric wires W and the terminals 4. After that, as shown in FIG. 5, the worker inserts from the rear side in FIG. 5 the terminals 4 connected by pressure bonding to the electric wires W into the window part 31 of the inner plate 3 so as to hold the terminals 4 in the inner plate 3.

At the inner plate insertion step, as shown in FIG. 6, the worker inserts from the front side the inner plate 3 holding the terminals 4 obtained at the terminal insertion step into the terminal accommodation space Sb of the terminal accommodation part 21. At that time, the lock arms 32 and 32 of the inner plate 3 engage with the locking pawls (not shown) formed in the right and left inner surfaces within the inner surface of the peripheral wall 211 of the terminal accommodation part 21. By virtue of this, the inner plate 3 is fixed to the connector housing 2. In association with the insertion of the inner plate 3, the electric wires W are accommodated in the electric wire accommodation space Sc of the electric wire accommodation part 22.

At the plug member insertion step, as shown in FIG. 7, the worker inserts the rubber plug 6 into the inside of the connector housing 2 obtained at the inner plate insertion step. More specifically, the worker press-fits from the rear side the rubber plug 6 into the inside of the plug member accommodation part 24 in a state that the electric wires W are inserted into the electric wire insertion holes 61. By virtue of this, the rubber plug 6 is fixed to the connector housing 2.

At the filling step, the worker causes the filler material 5 to fill the inside of the connector housing 2 obtained at the plug member insertion step and of then hardens the filler material 5. More specifically, the worker inserts a nozzle for ejecting the filler material 5 serving as a potting material from the front side of the connector housing 2 into a space between the inner surface of the connector housing 2 and the inner plate 3, then causes the filler material 5 to fill the inside of the filling space Sa in the inside of the connector housing 2, and then hardens the filler material 5. As a result, the connection part 42 for the electric wires W and the terminals 4 is covered by the hardened filler material 5. At that time, the filler material 5 adheres to the inner surface 22*a* of the electric wire accommodation part 22, the side surfaces 3*a* and 3*b* of the inner plate 3, and the side surface 6*a* of the rubber plug 6 on the front-end side in FIG. 2. On the other hand, the filler material 5 does not adhere to the inner surface 211*a* within the inner surface of the connector housing 2, where the release layer 9 is formed in the surface.

According to the injection method for filler material including the coating step and the filling step described above, the filler material 5 is caused to fill the inside of the connector housing 2 such that between the inner surface of the connector housing 2, the side surface 3*a* of the inner plate 3 and the outer surface of the filler material 5, the release layer 9 is formed that is interposed in contact with the inner surface of the connector housing 2 and with the side surface 3*a* of the inner plate 3 and with the outer surface of the filler material 5.

At the sealing member attachment step, as shown in FIG. 8, the worker attaches the O-ring 8 to the connector housing 2 obtained at the filling step.

As a result of the series of above-mentioned steps, the connector 1 is fabricated in which as shown in FIG. 2, between the inner surface of the connector housing 2, the side surface 3*a* of the inner plate 3 and the outer surface of the filler material 5, the release layer 9 is formed that is interposed in contact with the inner surface of the connector housing 2 and with the side surface 3*a* of the inner plate 3 and with the outer surface of the filler material 5. More specifically, the connector 1 is fabricated in which between the inner surface 211*a* of the terminal accommodation part 21 and the outer surface of the filler material 5 opposite to the inner surface 211*a*, the release layer 9 is formed that is interposed in contact with the inner surface 211*a* of the terminal accommodation part 21 and the outer surface of the filler material 5 opposite to the inner surface 211*a*.

The following description is given for the operation and the effect of the connector 1 and the injection method for filler material according to the present embodiment.

The connector 1 according to the present embodiment includes: a connector housing 2 having a tubular shape; an inner plate 3 that supports a terminal 4 connected to one-end portion of an electric wire W and that is accommodated in an inside of the connector housing 2; and filler material 5 that fills the inside of the connector housing 2 already accommodating the inner plate 3 and that is then hardened so as to cover a connection part 42 for the electric wire W and the terminal 4, wherein the filler material 5 adheres to an inner surface 22*a* of an electric wire accommodation part 22 serving as a first portion within an inner surface of the connector housing 2 and to a side surface 3*a* of the inner plate 3, and wherein between an inner surface 211*a* serving as a second portion within the inner surface of the connector housing 2 and the outer surface of the filler material 5 opposite to the inner surface 211*a*, a release layer 9 is formed that is composed of releasing material and is interposed in contact with the inner surface 211*a* and the outer surface of the filler material 5.

By virtue of this, the inner surface 211*a* and the outer surface of the filler material 5 opposite to the inner surface 211*a* are released from each other by the release layer 9 composed of releasing material and being interposed in contact with and between the inner surface 211*a* and the outer surface of the filler material 5. Thus, in comparison with a case of absence of the release layer 9, the extent of constraint on the filler material 5 by the connector housing 2 is alleviated. Thus, in comparison with a case of absence of the release layer 9, a larger amount of free expansion and free contraction is allowed to the filler material 5 when the ambient temperature of the connector 1 varies. This reduces a thermal stress generated in the filler material 5 and hence suppresses fatigue and degradation in the filler material 5. Further, a thermal shock generated in the filler material 5 is reduced. As a result, generation of cracks in the filler material 5 is suppressed.

Thus, according to the connector 1 according to the present embodiment, a connector can be provided in which generation of cracks in the filler material 5 filling the inside of the connector housing 2 can be suppressed.

Further, in a connector of the conventional art in which cracks are easily generated, in order to ensure the liquid-tight property of the inside of the connector housing 2, the sealing property of the rubber plug 6 need have been increased so that a cost increase has been caused. In contrast, according to the connector 1 according to the present embodiment, generation of cracks is suppressed. Thus, it is sufficient that the rubber plug 6 serves merely as a lid at the time of filling by the filler material 5. This avoids the necessity of an extremely high sealing property of the rubber plug 6. Thus, according to the connector 1 according to the present embodiment, the fabrication cost can be reduced.

Further, in the connector 1 according to the present embodiment, the release layer 9 is provided between an inner surface 211*a* serving as a second portion within the inner surface of the connector housing 2 and the outer surface of the filler material 5 adhering to a portion of the side surface 3*a* of the inner plate 3 opposite to the inner surface 211*a*.

In the connector 1 according to the present embodiment, the portion where the release layer 9 is formed is a portion where cracks are easily generated as described above. However, since the release layer 9 is formed in the portion, generation of cracks in the filler material 5 is suppressed.

In the connector 1 according to the present embodiment, the release layer 9 is formed such as to face a counterpart connector accommodation space Sd serving as a space for accommodating a counterpart connector housing within the inside of the connector housing 2.

By virtue of this, since the release layer 9 is formed such as to face the counterpart connector accommodation space Sd, the release layer 9 can be provided easily. Further, the extent of constraint on the filler material 5 by the connector housing 2 is alleviated. This reduces a thermal stress generated in the filler material 5 and hence suppresses generation of cracks in the filler material 5.

An injection method for filler material according to the present embodiment includes: a coating step of coating, with release material composed of releasing material, an inner surface 211*a* serving as a portion within an inner surface of a connector housing 2 having a tubular shape: and a filling step of causing filler material 5 to fill an inside of the connector housing 2 already accommodating an inner plate 3 for supporting a terminal 4 connected to one-end portion of an electric wire W such that the filler material 5 covers a connection part 42 for the electric wire W and the terminal 4 and then hardening the filler material 5 so that the filler material 5 adheres to an inner surface 22*a* serving as another portion within the inner surface of the connector housing 2 and to a side surface 3*a* of the inner plate 3 so that the filler material 5 is brought into contact with the release material.

By virtue of this, the filler material 5 is caused to fill the inside of the connector housing 2 such that the release layer 9 is formed between the inner surface 211*a* and the side surface 3*a* of the filler material 5 opposite to the inner surface 211*a*. As a result, a thermal stress generated in the filler material 5 is reduced and hence fatigue and degradation in the filler material 5 are suppressed. This suppresses generation of cracks in the filler material 5.

According to the injection method for filler material of the present embodiment, an injection method for filler material can be provided in which generation of cracks in the filler material 5 filling the inside of the connector housing 2 can be suppressed. Further, according to the fabrication method for the connector 1 including the injection method for filler material according to the present embodiment, a fabrication method for connector can be provided in which generation of cracks in the filler material 5 filling the inside of the connector housing 2 can be suppressed.

Here, the technical scope of the present invention is not limited to the embodiment described above. In the embodiment described above, various kinds of modifications, improvements, and the like may be made within the technical scope of the present invention.

For example, the connector 1 according to the present embodiment had a configuration that the filler material 5 is fixed to the entirety of the inner surface 22*a* of the electric wire accommodation part 22 and that the release layer 9 is formed between the inner surface 211*a* of the terminal accommodation part 21 and the outer surface of the filler material 5 opposite to the inner surface 211*a*. Instead, the position where the release layer 9 is provided may be located at another position within the inner surface of the connector housing 2. For example, a configuration may be employed that the filler material 5 is fixed to a portion of the inner surface 22*a* of the electric wire accommodation part 22 and that the release layer 9 is formed between another portion of the inner surface 22*a* of the electric wire accommodation part 22 and the outer surface of the filler material 5 opposite to the another portion of the inner surface 22*a*. Further, in this case, the inner surface 211*a* of the terminal accommodation part 21 serving as the second portion within the inner surface of the connector housing 2 in the present embodiment may be fix to the filler material 5.

The connector and the injection method for filler material of the present invention are useful in the point that generation of cracks in filler material filling the inside of a connector housing can be suppressed.

What is claimed is:

1. A method for injecting filler material into a connector housing of an electrical connector, comprising:

an coating step of coating, with a layer of release material, a first portion within an inner surface of the connector housing having a tubular shape; and a filling step of filling the filler material into an inside of the connector housing which has accommodated an inner plate supporting a terminal connected to one end portion of an electric wire such that the filler material covers a connection part of the electric wire and the terminal, and then hardening the filler material so that the filler material adheres to a second portion within the inner surface of the connector housing and to an outer surface of the inner plate so that the filler material is brought into contact with the release material coated on the first portion within the inner surface of the connector housing.

2. The method according to claim 1, wherein the coating step includes forming the release layer abutting a step separating the first portion from the second portion of the inner surface of the connector housing.

3. The method according to claim 1, wherein the first and second portions of the inner surface of the connector housing are a front portion and a rear portion, respectively.

* * * * *